US005251794A

United States Patent [19]

Toaldo

[11] Patent Number: 5,251,794

[45] Date of Patent: Oct. 12, 1993

[54] REFRACTORY ASSEMBLY WITH METAL SHEATH TO PREVENT MOLTEN METAL BREAKTHROUGH

[75] Inventor: Walter Toaldo, Zug, Italy

[73] Assignee: Stopinc Aktiengesellschaft, Baar, Switzerland

[21] Appl. No.: 902,893

[22] Filed: Jun. 23, 1992

[30] Foreign Application Priority Data

Jul. 12, 1991 [CH] Switzerland ..... 02081/91

[51] Int. Cl.[5] ..... B22D 41/28

[52] U.S. Cl. ..... 222/600; 266/236

[58] Field of Search ..... 222/397, 600, 591; 266/236

[56] References Cited

U.S. PATENT DOCUMENTS 4,376,501 3/1983 Hafner et al. ..... 222/600
4,415,103 11/1983 Shapland et al. ..... 222/600
5,074,442 12/1991 Fricker ..... 222/600

FOREIGN PATENT DOCUMENTS 3805074 9/1988 Fed. Rep. of Germany .
88/01211 2/1988 World Int. Prop. O. .

*Primary Examiner*—Scott Kastler
*Attorney, Agent, or Firm*—Wenderoth, Lind & Ponack

[57] ABSTRACT

A refractory assembly for use in a sliding closure unit to control the discharge of molten metal from a metallurgical vessel includes a refractory plate having therethrough a discharge opening and having a sliding surface. A metal sheath is mounted exteriorly of the refractory plate. The sheath includes a protruding collar surrounding the discharge opening and extending in a direction away from the sliding surface beyond a portion of the refractory plate that confronts a refractory sleeve of the sliding closure unit to define therewith a joint. The protruding collar encloses the joint outwardly and thereby prevents molten metal breakthrough at the joint.

39 Claims, 2 Drawing Sheets

REFRACTORY ASSEMBLY WITH METAL SHEATH TO PREVENT MOLTEN METAL BREAKTHROUGH

BACKGROUND OF THE INVENTION

The present invention relates to refractory assemblies employed in a slide gate or sliding closure unit for controlling the discharge of molten metal from a metallurgical vessel. Particularly, the present invention relates to such an assembly for use as a stationary plate assembly or as a slidable plate assembly and including a refractory plate having therethrough at least one discharge opening and having a sliding surface, with a metal sheath mounted exteriorly of the refractory plate.

One known refractory plate assembly of this type is disclosed in DE-PS 38 05 074, corresponding to U.S. Pat. No. 5,074,442. Such known assembly includes a metal sheath that extends in a direction away from the sliding surface to a position to be level with the opposite side of the refractory plate, i.e. to be level with that portion of the refractory plate that confronts a refractory sleeve of the sliding closure unit to define therewith a joint. In other words, that end of the metal sheath is flush with the respective end or portion of the refractory plate opposite to the sliding surface thereof. The joint between the refractory sleeve and this end or portion of the refractory plate is from 3 to 5 mm. To provide a seal of this joint between the refractory plate and the refractory sleeve, there is provided in the joint a commercially available refractory material, for example a refractory mortar. In practical operation however it can occur that the mortar is not perfectly distributed over the entire joint or it can occur that the sleeve is spaced too far from the plate, such that there is too little mortar to fill the joint. As a result, the joint is not satisfactorily sealed around the passage defined by discharge openings through the sleeve and plate. In the worst case, this condition can lead to so-called molten metal breakthrough, i.e. where molten metal passes laterally through the joint, thus flowing out between the sleeve and the plate. This can lead to total destruction of the sliding closure unit.

SUMMARY OF THE INVENTION

With the above discussion in mind, it is an object of the present invention to provide a refractory plate assembly including a refractory plate and metal sheath whereby the above and other prior art disadvantages are overcome.

It is a further object of the present invention to provide a refractory plate assembly including the refractory plate and metal sheath and also including the refractory sleeve defining a joint with the refractory plate, but wherein it is possible to overcome the above and other prior art disadvantages.

It is an even further object of the present invention to provide an improved metal sheath having structure to overcome the above and other prior art disadvantages.

It is a yet further object of the present invention to provide such assemblies and sheath of a simple and inexpensive construction whereby the risk of molten metal breakthrough is significantly reduced and whereby the reliability of operation of the sliding closure unit is improved.

These objects are achieved in accordance with one aspect of the present invention by the provision of a refractory plate assembly for use as a stationary plate assembly or as a slidable plate assembly in a sliding closure unit, such assembly including a refractory plate having therethrough a discharge opening and having a sliding surface, and a metal sheath mounted exteriorly of the refractory plate, the sheath including a protruding collar surrounding the discharge opening and extending in a direction away from the sliding surface beyond a portion of the refractory plate that is intended, upon use of the assembly, to confront a refractory sleeve of the sliding closure unit to define therewith a joint.

The above objects are achieved in accordance with a further aspect of the present invention by the provision of an assembly including such refractory plate assembly and also including the refractory sleeve having therethrough a discharge opening aligned with the discharge opening through the refractory plate, the refractory plate and the refractory sleeve defining therebetween a joint.

The above objects are achieved in accordance with a yet further aspect of the present invention by the provision of an improved metal sheath to be mounted exteriorly of a refractory plate and including means for, during operation for discharge of molten metal, preventing molten metal from flowing from the discharge openings of a refractory sleeve and the refractory plate laterally outwardly entirely through a joint between the sleeve and the plate, such means comprising a protruding collar extending from the sheath in a direction to be toward the refractory sleeve during operation, such protruding collar being shaped to surround the discharge opening of the refractory plate when mounted thereon and being of a dimension to extend in such direction beyond the portion of the refractory plate confronting the refractory sleeve by a distance at least equal to the intended thickness of the joint to be defined between the refractory sleeve and the refractory plate.

The provision of the protruding collar in accordance with the above aspects of the present invention makes it possible to substantially entirely avoid the problem of molten metal breakthrough, i.e. molten metal flowing through the joint between the refractory sleeve and the refractory collar. This is due to the fact that the protruding collar encloses the joint and results in a decisive improvement in the function of sealing of the joint. Even if the joint is not entirely 100 percent filled with mortar, and during a molten metal discharge operation molten metal infiltrates into the joint, the molten metal is prevented by the protruding collar from flowing out to the exterior of the joint into the sliding closure unit. Therefore, the sliding closure unit is prevented from being damaged or even destroyed by such molten metal breakthrough.

Even further, the provision of the protruding collar according to the present invention has an additional and surprising effect that, when preparing an assembly of a refractory plate and a metal sheath to be mounted into a sliding closure unit, the protruding collar of the metal sheath serves as a gauge, whereby the mortar can be applied to the face of the refractory plate within the annular protruding collar. In this manner, on the one hand, the goal is achieved that the initially plastic mortar compound is always applied in approximately a uniform quantity and manner. On the other hand, the collar prevents the mortar compound from flowing radially outwardly in an uncontrolled manner when the refractory plate is set into position.

In an advantageous embodiment of the present invention, the annular protruding collar is bent inwardly. Such collar can be bent in such a manner to extend inwardly by 90° and thus form a spacer that abuts below the outer face of the plate.

In a particular embodiment of the present invention, the annular protruding collar envelopes at least the anticipated joint between the refractory plate and the refractory sleeve. Thus, security against potential molten metal breakthrough is achieved over the entire extent of the assembly. Furthermore, in one particular arrangement of the present invention, the collar protrudes from the refractory plate by a distance such that the adjacent end of the refractory sleeve is enveloped by the collar with virtually no clearance therebetween. In accordance with an even further arrangement of the present invention, the collar can project into an annular groove formed in the adjacent end of the refractory sleeve.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
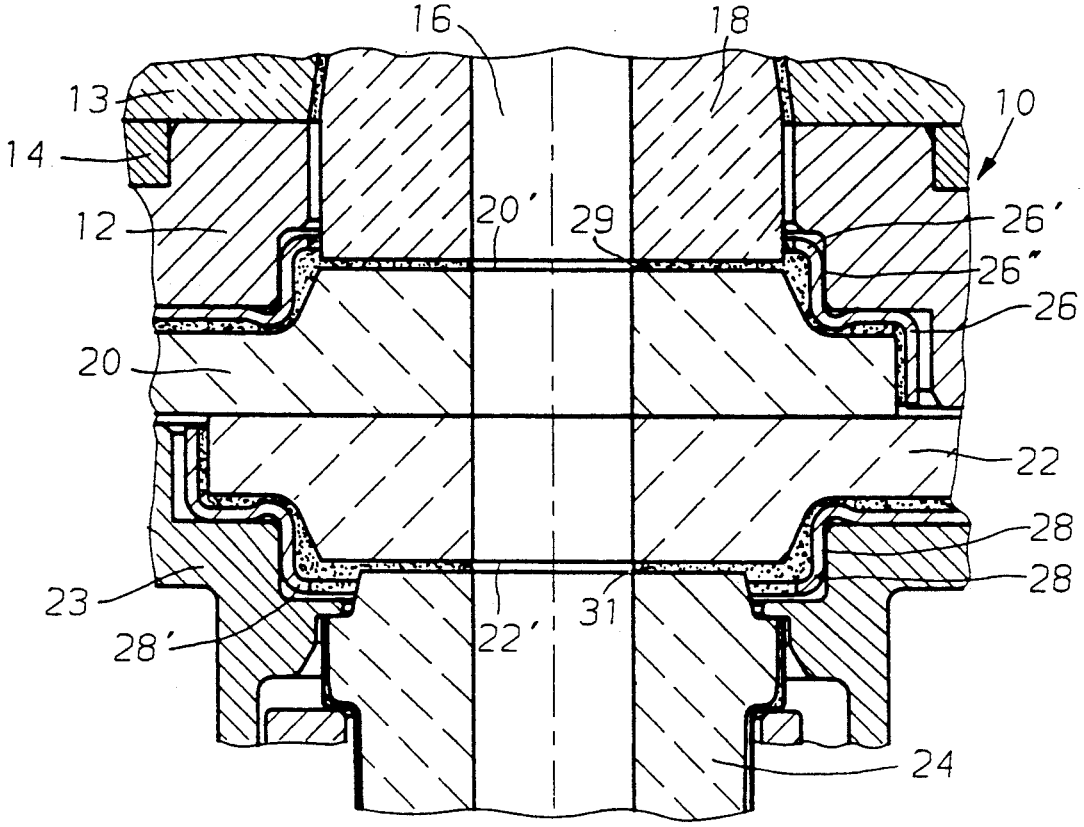
FIG. 1 is a partial longitudinal cross-sectional view of a portion of a sliding closure unit incorporating the assemblies and the metal sheath of one embodiment of the present invention.

In FIG. 1 is illustrated, in partial cross-sectional view, a slide gate or sliding closure unit 10 of the type disclosed in EP-PS 0 277 146, with the exception of the novel features of the present invention. Thus, slide gate 10 includes a metal housing 12 which is attached to an outer wall 14 of a metallurgical vessel adapted to contain molten metal, for example a ladle having an inner refractory lining 13. An outlet passage 16 from the vessel is defined by a refractory sleeve 18 mounted in lining 13. A stationary refractory shut-off plate 20 is arranged in housing 12 in such a manner that a portion of plate 20 confronts an end face of sleeve 18 by a predetermined distance, for example 3 to 5 mm. Refractory plate 20 is arranged stationarily in housing 12 and has on the opposite side a sliding surface against which is pressed a longitudinally slidable or movable refractory shut-off plate 22. Plate 22 in turn is mounted in a metal slide unit 23 in which is also mounted an adjacent replaceably refractory spout sleeve 24. The sleeves 18, 24 form together with the shut-off plates 20, 22, in the open position of the slide gate as illustrated, the discharge passage or opening 16 that enables molten metal to be discharged from the metallurgical vessel. By moving the refractory shut-off plate 22, for example by longitudinal sliding thereof, the molten metal can be discharged in a controlled manner, or the molten metal flow can be totally interrupted.

Each refractory plate 20, 22 has mounted exteriorly thereof a metal sheath 26, 28, respectively, for example formed of a plate steel. Thus, an assembly is formed by each refractory plate 20, 22 being mortared into a respective metal sheath 26, 28, i.e. each metal sheath is mounted exteriorly of the respective refractory plate. Each sheath 26, 28 has a cylindrical centering surface 26″, 28″ that is centered around a refractory continuation of or projection of the respective refractory plate and also centered relative to the respective discharge opening. This arrangement ensures that plate 20 is centered in housing 12 and that plate 22 is centered in slide unit 23.

In accordance with the present invention, extending from each centering surface 26″, 28″ that is coaxial to the respective discharge opening is a collar 26′, 28′ that protrudes from the side or portion 20′, 22′ of the respective refractory plate facing away from the sliding surface thereof. Each collar 26′, 28′ extends from portion 20′, 22′ by a distance sufficient to substantially enclose a joint 29, 31 formed between the respective plate 20, 22 and the adjacent sleeve 18, 24. The provision of this structural feature of collar 26′, 28′ provides the significant advantage that the risk of molten metal breakthrough through the joint between the refractory plate and the refractory sleeve can be avoided or at least significantly reduced.

When assembling and positioning the refractory assembly, first mortar is inserted into the cavity formed by the collar 26′, 28′, and this procedure can be effected quite accurately without any expense. Then, the respective plate 20, 22 is inserted into the respective metal sheath 26, 28, and this assembly is positioned into the respective housing 12 or slide unit 23. During such operation, the collar 26′, 28′ ensures that mortar will not be caused to issue unimpeded in a lateral outward direction out of the joint 29, 31. Thus, the collar is constructed in a manner such that it is bent inwardly and encloses the respective sleeve in the installed position with very little clearance therebetween, for example 0.5 to 3 mm. Thus, it is to be expected that there will be a normal variation of the distance of the thickness of the joint between the sleeve and the plate. Even with such variations, it is ensured that the end of the sleeve will be enveloped by the collar. The risk of such varying distance does not significantly exist with regard to the bottom sleeve 24 that always has a defined distance relative to the bottom portion 22′ of plate 22. Even so, the upper end of sleeve 24 also is suitably enveloped by collar 28′. In the arrangement shown in FIG. 1, the plates 20, 22 are identical, a feature that, as is known, significantly simplifies fabrication.

Figure 2:
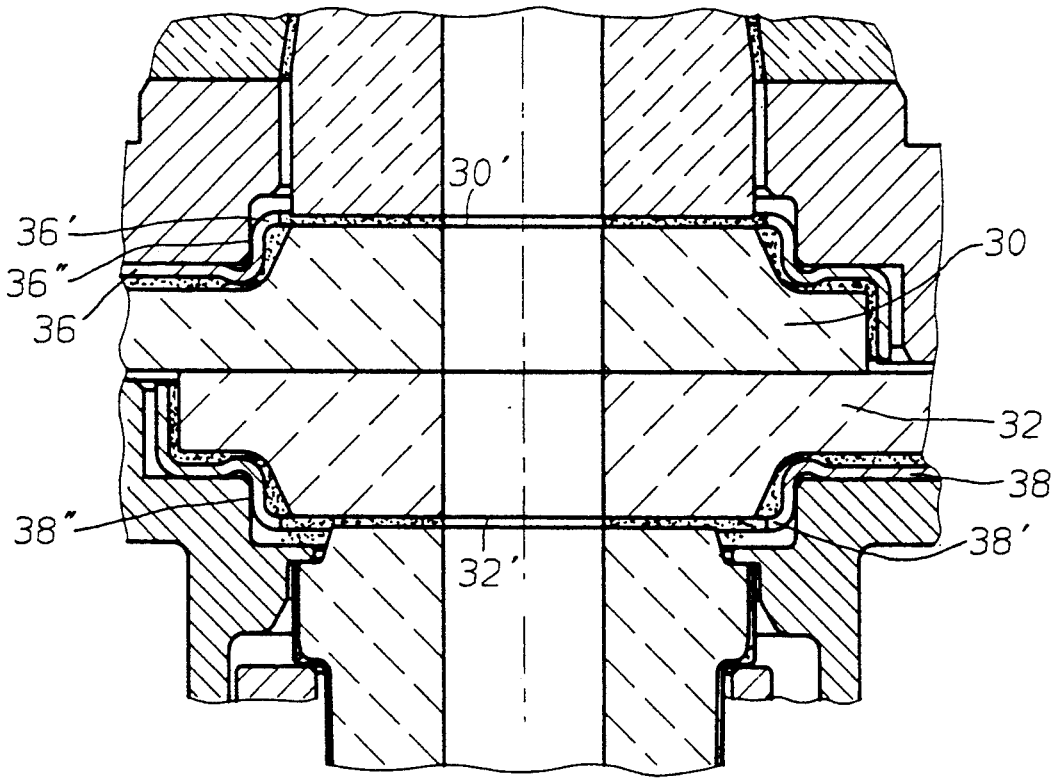
FIGS. 2–4 are views similar to FIG. 1, but illustrating further embodiments of the various aspects of the present invention.

In the embodiment of FIG. 2, the structure substantially is the same as in FIG. 1, with the exception that collars 36′, 38′ of respective metal sheaths 36, 38 protrude relative to plate faces 30′, 32′ of plates 30, 32 by a distance only approximately equal to the thickness of the metal material forming the sheaths. In this case also however, collars 36′, 38′ ensure that a defined and gauged quantity of mortar can be used when assembling the plates to the sheaths and when assembling the plate-sheath assemblies in the frame or the slide unit. Additionally, it also is ensured in this embodiment that, when the plates are so inserted, mortar will not be discharged laterally outwardly in an unimpeded manner. This embodiment also provides that centering surfaces 36″, 38″ will ensure centering of the plates 30, 32 in the housing, slide unit, respectively. Additionally, in this embodiment the collars 36′, 38′, entirely enclose the respective joints between the plates and the sleeves, thereby preventing molten metal breakthrough.

Figure 3:
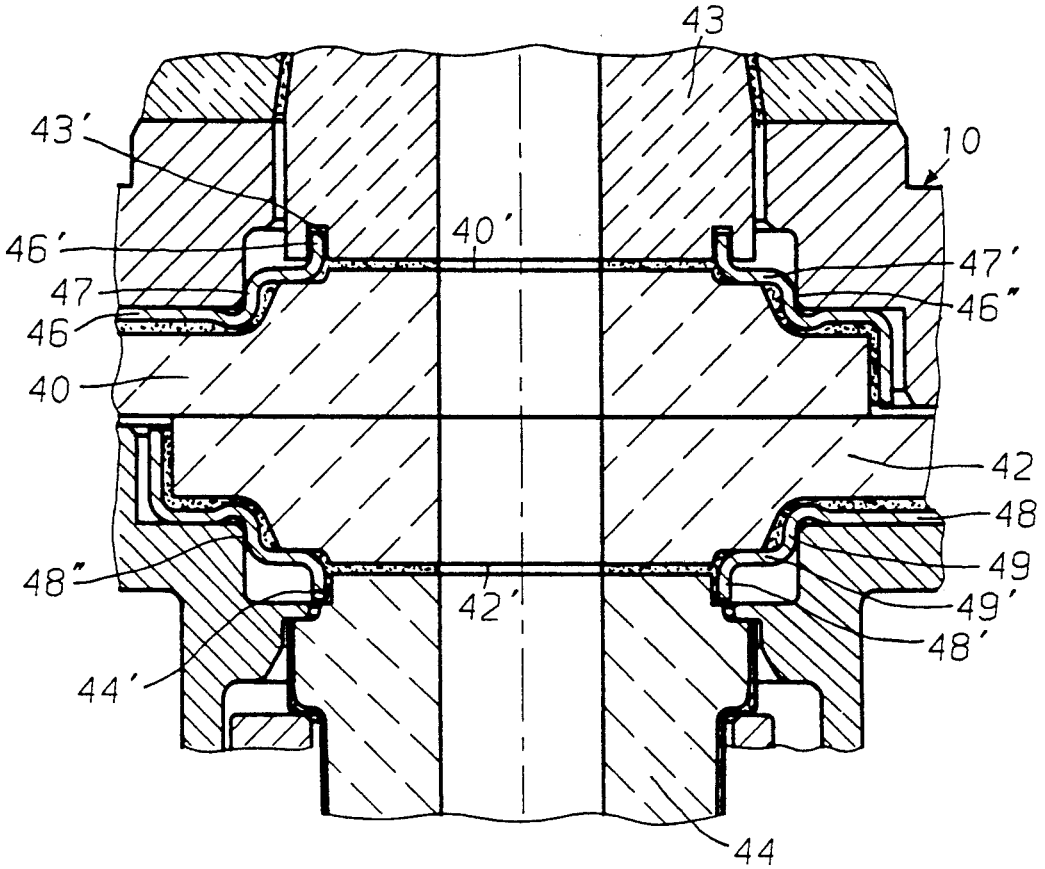

In the embodiment of FIG. 3, each sheath 46, 48 has a cylindrical portion 47, 49 defining a cylindrical centering surface 46″, 48″ enclosing a refractory continuation or projection of plate 40, 42, thus centering the plates. From such cylindrical portions the sheath includes annular surface portions 47', 49' bent inwardly by 90° and resting on an annular surface of the continuation or projection of the refractory plate. From portions 47', 49' extend protruding collars 46', 48' that extend axially from respective plate faces or portions 40', 42'. Collars 46', 48' define rings that project into respective annular grooves 43', 44' formed in refractory sleeves 43, 44. The cross section of each annular groove 43', 44' is larger on all sides by approximately 1 mm than is the cross section of the respective collar 46', 48'. This embodiment of the present invention has all of the advantages discussed above regarding the embodiments of FIGS. 1 and 2. Additionally, this embodiment has the advantage that, if the joint enveloped by the respective collar has only some mortar, or in the worst case no mortar at all, any molten metal infiltrating the joint would be cooled or even solidified upon contact with the collar that totally envelopes the joint. Thus, a potentially larger molten metal breakthrough can be avoided.

Figure 4:
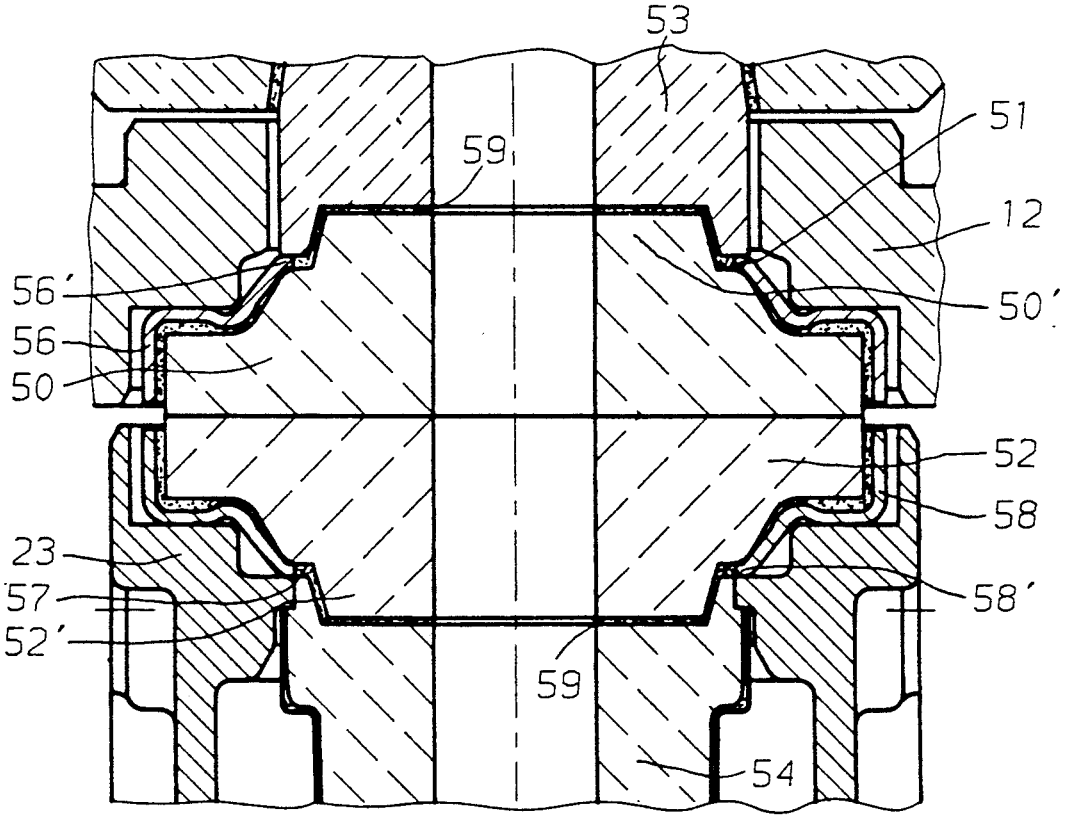

In the embodiment of FIG. 4, it is contemplated that refractory plates 50, 52 are mortared into respective sheaths 56, 58 and inserted into the housing 12 and slide unit 23, respectively. In so doing, plates 50, 52 are fastened by clamping means (not shown). Additionally, plates 50, 52 include so-called tongues 50', 52' which fit into corresponding grooves or recesses in sleeves 53, 54. This groove-tongue assembly method has the advantage, in addition to the advantages discussed above, that it provides a type of labyrinth seal by means of which infiltration of molten metal into the joints 59 further is virtually eliminated. Each sheath 56, 58 has a collar 56', 58' that is bent inwardly and that rests directly on an outer face or portion 51, 57 of the respective plate that defines a joint with the respective sleeve 53, 54. Therefore, collar 56, 58 partially fills this joint that is part of the joint 59, i.e. the collar essentially forms a spacer of such labyrinth joint at the outer circumference thereof. In place of mortar, it is possible to employ a refractory ring, for example a fiber mat, or a combination of such features, could be employed for joint 59. The embodiment of FIG. 4 has all of the advantages of the embodiments discussed above. Particularly, the joint is entirely closed by the collar of the metal sheath, thus essentially preventing molten metal breakthrough.

Although the present invention has been described and illustrated with respect to preferred embodiments thereof, it is to be understood that various changes and modifications may be made to the specifically described and illustrated features without departing from the scope of the present invention.

I claim:

1. A refractory plate assembly for use as a stationary plate assembly or as a slidable plate assembly in a sliding closure unit for controlling the discharge of molten metal from a metallurgical vessel, said refractory plate assembly comprising:

a refractory plate having therethrough a discharge opening, a sliding surface, and an integral refractory continuation coaxial to said discharge opening and projecting from a surface of said refractory plate opposite said sliding surface, said continuation including a portion to confront a refractory sleeve of the sliding closure unit and to define therewith a joint; and a metal sheath mounted exteriorly of said refractory plate, said sheath including a protruding collar surrounding said discharge opening, said protruding collar surrounding said continuation coaxially and extending in a direction away from said sliding surface beyond said portion of said refractory plate that is to confront the refractory sleeve of the sliding closure unit to define therewith the joint.

2. An assembly as claimed in claim 1, wherein said protruding collar comprises an annular elongation of said sheath.

3. An assembly as claimed in claim 1, wherein said protruding collar has a diameter corresponding approximately to an outer diameter of said refractory continuation.

4. An assembly as claimed in claim 1, wherein said sheath includes a cylindrical centering surface located coaxially of said discharge opening, and said protruding collar comprises an elongation of said centering surface.

5. An assembly as claimed in claim 1, wherein said protruding collar extends radially inwardly of said sheath.

6. An assembly as claimed in claim 1, wherein said portion of said refractory plate comprises an annular surface, and said protruding collar rests on said annular surface.

7. An assembly as claimed in claim 6, wherein said annular surface is planar.

8. An assembly as claimed in claim 6, wherein said protruding collar extends radially inwardly and transversely of said discharge opening.

9. An assembly as claimed in claim 6, wherein said annular surface surrounds a refractory projection of said refractory plate that extends in said direction beyond said planar surface.

10. An assembly as claimed in claim 1, wherein said protruding collar extends axially of said discharge opening.

11. An assembly as claimed in claim 1, wherein said protruding collar projects beyond said portion of said refractory plate by a distance of 5 to 20 mm.

12. An assembly as claimed in claim 1, wherein said sheath includes a section contacting an annular surface of said refractory plate, and said protruding collar comprises an annular projection extending from said section.

13. An assembly as claimed in claim 1, wherein said refractory plate is mounted in said sheath by mortar.

14. An assembly for use in a sliding closure unit for controlling the discharge of molten metal from a metallurgical vessel, said assembly comprising;

a refractory sleeve having therethrough a discharge opening;

a refractory plate having therethrough a discharge opening, a sliding surface, and an integral refractory continuation coaxial to said plate discharge opening and projecting from a surface of said refractory plate opposite said sliding surface, said continuation including a portion to confront said refractory sleeve;

said refractory plate being assembled to said refractory sleeve with said discharge openings in alignment and with said portion of said refractory plate confronting said refractory sleeve and defining a joint therebetween;

a metal sheath mounted exteriorly of said refractory plate, said sheath including a protruding collar surrounding said plate discharge opening, said protruding collar surrounding said continuation coaxially and extending in a direction away from said sliding surface beyond said portion of said refractory plate.

15. An assembly as claimed in claim 14, wherein said protruding collar comprises an annular elongation of said sheath.

16. An assembly as claimed in claim 14, wherein said protruding collar has a diameter corresponding approximately to an outer diameter of said refractory continuation.

17. An assembly as claimed in claim 14, wherein said sheath includes a cylindrical centering surface located coaxially of said plate discharge opening, and said protruding collar comprises an elongation of said centering surface.

18. An assembly as claimed in claim 14, wherein said protruding collar extends radially inwardly of said sheath.

19. An assembly as claimed in claim 14, wherein said portion of said refractory plate comprises an annular surface, and said protruding collar rests on said annular surface.

20. An assembly as claimed in claim 19, wherein said annular surface is planar.

21. An assembly as claimed in claim 19, wherein said protruding collar extends radially inwardly and transversely of said discharge opening.

22. An assembly as claimed in claim 19, wherein said annular surface surrounds a refractory projection of said refractory plate that extends in said direction beyond said planar surface.

23. An assembly as claimed in claim 14, wherein said protruding collar extends axially of said plate discharge opening.

24. An assembly as claimed in claim 14, wherein said protruding collar projects beyond said portion of said refractory plate by a distance of 5 to 20 mm.

25. An assembly as claimed in claim 14, wherein said sheath includes a section contacting an annular surface of said refractory plate, and said protruding collar comprises an annular projection extending from said section.

26. An assembly as claimed in claim 14, wherein said refractory plate is mounted in said sheath by mortar.

27. An assembly as claimed in claim 14, wherein said joint has therein mortar.

28. An assembly as claimed in claim 14, wherein said protruding collar surrounds at least said joint.

29. An assembly as claimed in claim 14, wherein said protruding collar extends axially at least across said joint.

30. An assembly as claimed in claim 14, wherein said protruding collar encloses an end of said refractory sleeve facing said refractory plate with substantially no clearance therebetween.

31. An assembly as claimed in claim 14, wherein said refractory sleeve has formed therein an annular groove, and said protruding collar fits in said groove.

32. An assembly as claimed in claim 31, wherein said collar fits in said groove with substantially no clearance therebetween.

33. An assembly as claimed in claim 31, wherein said groove is formed in an end face of said sleeve, and said collar extends axially.

34. In a metal sheath, to be mounted exteriorly of a refractory plate having an integral refractory continuation and that is intended to be mounted with a portion of the refractory continuation confronting a refractory sleeve to define therewith a joint and with discharge openings of the refractory plate and the refractory sleeve aligned and opening into the joint, to thus form part of a sliding closure unit for use in controlling the discharge of molten metal from a metallurgical vessel through the aligned discharge openings, the improvement wherein said sheath includes means for, during operation for discharge of molten metal, preventing molten metal from flowing from the discharge openings laterally outwardly entirely through the joint, said means comprising:

a protruding collar extending from said sheath in a direction to be toward the refractory sleeve during operation, said protruding collar being shaped to coaxially surround the refractory continuation and the discharge opening of the refractory plate when mounted thereon and being of a dimension to extend in said direction beyond the portion of the refractory plate by a distance at least equal to the intended thickness of the joint.

35. The improvement claimed in claim 34, wherein said protruding collar comprises an annular elongation of said sheath.

36. The improvement claimed in claim 34, wherein said sheath includes a cylindrical centering surface, and said protruding collar comprises an elongation of said centering surface.

37. The improvement claimed in claim 33, wherein said protruding collar extends radially inwardly of said sheath.

38. The improvement claimed in claim 34, wherein said protruding collar extends axially.

39. The improvement claimed in claim 34, wherein said dimension is 5 to 20 mm.

* * * * *